US009383763B1

(12) United States Patent
Liu et al.

(10) Patent No.: US 9,383,763 B1
(45) Date of Patent: Jul. 5, 2016

(54) MULTIMODE CURRENT MIRROR CIRCUITRY

(71) Applicant: Altera Corporation, San Jose, CA (US)

(72) Inventors: Xiong Liu, Cupertino, CA (US); Thungoc M. Tran, San Jose, CA (US); Tim Tri Hoang, San Jose, CA (US); Wilson Wong, San Francisco, CA (US); Vishal Giridharan, San Jose, CA (US)

(73) Assignee: Altera Corporation, San Jose, CA (US)

( * ) Notice: Subject to any disclaimer, the term of this patent is extended or adjusted under 35 U.S.C. 154(b) by 266 days.

(21) Appl. No.: 14/146,913

(22) Filed: Jan. 3, 2014

(51) Int. Cl.
*G05F 3/26* (2006.01)

(52) U.S. Cl.
CPC . *G05F 3/262* (2013.01); *G05F 3/26* (2013.01)

(58) Field of Classification Search
CPC ..... G05F 3/16; G05F 3/26; G05F 3/262
See application file for complete search history.

(56) References Cited

U.S. PATENT DOCUMENTS 5,311,115 A 5/1994 Archer
5,426,598 A 6/1995 Hagihara
6,265,859 B1 * 7/2001 Datar ..... G06F 3/262 323/312
7,514,989 B1 * 4/2009 Somerville ..... G05F 3/26 327/538
8,450,992 B2 5/2013 Tesu et al.
2005/0099748 A1 * 5/2005 Aemireddy ..... G05F 3/262 361/82
2008/0297234 A1 * 12/2008 Moholt ..... G05F 3/262 327/541
2012/0044012 A1 * 2/2012 Shibayama ..... G05F 3/26 327/437

* cited by examiner

*Primary Examiner* — Fred E Finch, III

(57) ABSTRACT

In one embodiment, an integrated circuit current mirror circuit is disclosed. The integrated circuit current mirror circuit includes a reference circuit, an output circuit and a mode selector circuit. The reference circuit includes an input terminal that receives a reference current. The output circuit generates an output current that is proportional to the reference current. The output circuit is coupled to a load circuit. The output current is provided to the load circuit. The mode selector circuit is coupled to the reference circuit and the output circuit. The mode selector circuit receives a plurality of mode control signals having different voltage levels. The mode selector circuit selects one of the mode control signals. The selected mode control signal is routed to the reference circuit and the output circuit to place the current mirror circuit in a desired mode.

18 Claims, 6 Drawing Sheets

MULTIMODE CURRENT MIRROR CIRCUITRY

BACKGROUND

A current mirror circuit generates a constant output electrical current from a reference electrical current in an integrated circuit (IC). The term "mirror" refers to the act of copying the reference electrical current to generate the output electrical current. Current mirror circuits are mostly utilized to supply current to other circuits or, in some instances, to form an active load for circuits.

There are many different types of current mirror circuits, for example, baseline current mirror circuits, cascode current mirror circuits, and Wilson current mirror circuits. Each type of current mirror circuits may have different circuit characteristics. Several circuit characteristics that are usually used for defining a particular current mirror circuit may be output impedance, current gain factor, and output voltage swing.

A current mirror circuit with an output electrical current that is not proportional to its reference electrical current may be a defective current mirror circuit. Generally, a defective current mirror circuit may be caused by large variations in the integrated circuit manufacturing process. A defective current mirror circuit may be repaired by changing the layout masks where the defects are observed. However, changing layout masks to resolve this issue may be costly and thus unfavorable.

It is within this context that the embodiments described herein arise.

SUMMARY

Embodiments described herein include methods and structures related to a current mirror circuit having multiple modes of operation. It should be appreciated that the embodiments can be implemented in numerous ways, such as a process, an apparatus, a system, a device, or a method. Several embodiments are described below.

In one embodiment, a current mirror circuit for an integrated circuit is disclosed. The current mirror circuit may include a reference circuit, an output circuit, and a mode selector circuit. The reference circuit includes an input terminal to receive a reference current. The output circuit generates an output current that may be substantially proportional to the reference current. The output circuit is coupled to a load circuit. The output current is provided to the load circuit. The mode selector circuit is coupled to the reference circuit and the output circuit. The mode selector circuit receives a plurality of mode control signals having different voltage levels and selects one of the mode control signals. The selected mode control signal is routed to the reference circuit and the output circuit to place the current mirror circuit in a desired mode.

In addition to that, a method of operating a current mirror circuit is also disclosed. The current mirror circuit may include a reference circuit and an output circuit. The method includes a step to receive one of a plurality of mode control signals through a mode selector circuit. Each of the mode control signal may be used to place the current mirror circuit in a different mode. The method also includes a step to receive a reference current on the reference circuit branch. Finally, the method also includes a step to generate an output current on the output circuit branch. When the current mirror circuit is placed in a selected mode, the output current may be substantially proportional to the reference current.

An alternative method of operating a current mirror circuit is also disclosed. The current mirror circuit, as described above, may also include a mode selector circuit to select an operating mode for the current mirror circuit. The method includes a step to select a cascode mode for the current mirror circuit using the mode selector circuit. The method further includes a step to compare a reference current that is received by the current mirror circuit and an output current that is generated by the current mirror circuit.

Further features of the invention, its nature and various advantages will be more apparent from the accompanying drawings and the following detailed description of the preferred embodiments.

DETAILED DESCRIPTION

The following embodiments describe methods and structures related to a current mirror circuit having multiple modes of operation. It will be obvious to one skilled in the art that the present exemplary embodiments may be practiced without some or all of these specific details. In other instances, well-known operations have not been described in detail in order not to unnecessarily obscure the present embodiments.

Figure 1:
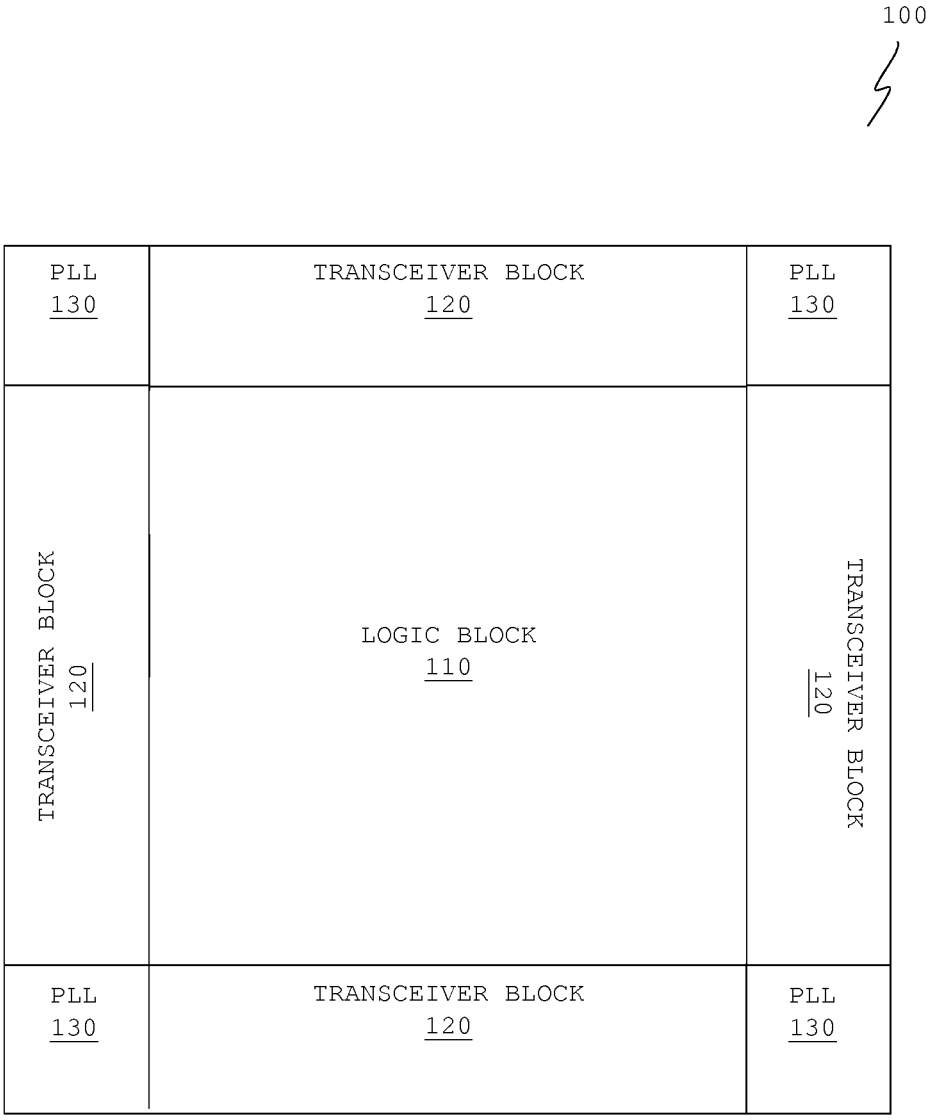
FIG. 1 shows an illustrative integrated circuit in accordance with one embodiment of the present invention.

FIG. 1, meant to be illustrative and not limiting, illustrates integrated circuit 100 in accordance with one embodiment of the present invention. Integrated circuit 100 may be an application specific integrated circuit (ASIC) device, an application standard specific product (ASSP) device or a programmable logic device (PLD). In general, ASIC and ASSP devices may perform fixed and dedicated functions whereas PLD devices may be programmable to perform a variety of functions. An example of a PLD device may be a field programmable gate array (FPGA) device.

Integrated circuit 100 may be used in different communication systems such as wireless systems, wired systems, etc. In one embodiment, integrated circuit 100 may be a PLD that is utilized for controlling data transfer between different devices, for example, microprocessor devices and memory devices. Hence, integrated circuit 100 may include circuits that may be used to implement various protocol standards that allow integrated circuit 100 to communicate with external devices such as memory devices (not shown) that may be coupled to integrated circuit 100.

Integrated circuit 100 may include logic block 110 and a plurality of transceiver blocks 120. In the embodiment of FIG. 1, the plurality of transceiver blocks 120 may be located at a peripheral region of integrated circuit 100 and logic block 110 may occupy a center region of integrated circuit 100. It should be appreciated that the arrangement of transceiver blocks 120 and logic block 110 on integrated circuit 100 may vary depending on the requirements of a particular device.

Logic block 110 may be utilized for performing core functions of integrated circuit 100. It should be appreciated that logic block 110 may include circuits specific to the functions that define integrated circuit 100. In one example, logic block 110 may include circuits to perform memory device addressing and processing of information retrieved from the memory device when integrated circuit 100 is used as a memory controller. In another example, logic block 110 may include programmable logic elements when integrated circuit is a PLD. The programmable logic elements may further include circuits such as look-up table circuitry, multiplexers, product-term logic, registers, memory and the like, as person skilled in the art with the benefit of the description of the invention understands. The programmable logic elements may be programmed by a user (e.g., a designer or an engineer) to perform any desired function.

Signals from logic block 110 may be transferred out of integrated circuit 100 through one of the plurality of transceiver blocks 120. Accordingly, signals received from a device that is external to integrated circuit 100 may be transferred to circuitry within logic block 110 through one of the transceiver blocks 120. Accordingly, transceiver blocks 120 may be known as external interfacing circuitry of integrated circuit 100.

In the embodiment of FIG. 1, phase-locked loop (PLL) circuits 130 are located at the corners of integrated circuit 100. PLL circuits 130, together with transceiver 120, may be utilized for locking an internal clock signal to on an external clock signal. As an example, PLL circuits 130 may be utilized when integrated circuit 100 communicates with an external memory module.

In one embodiment, logic block 110 may include mostly digital circuits that process digital signals whereas transceiver blocks 120 and PLL circuits 130 may include mostly analog circuits that process analog signals. A digital signal, generally, is a discrete signal that shifts between two logic levels (e.g., logic one and logic zero) whereas an analog signal is a continuous signal that varies according to a continuous function of time.

Analog circuits in transceiver blocks 120 and PLL circuits 130 may include a current mirror circuit (not shown in FIG. 1). It should be appreciated that a current mirror circuit regulates electrical current that is transmitted through a load circuit such that it is substantially proportional to a reference electrical current. In one embodiment, a current mirror circuit may be coupled to sub-circuits within PLL circuits 130 and/or sub-circuits within transceiver blocks 120.

Figure 2:
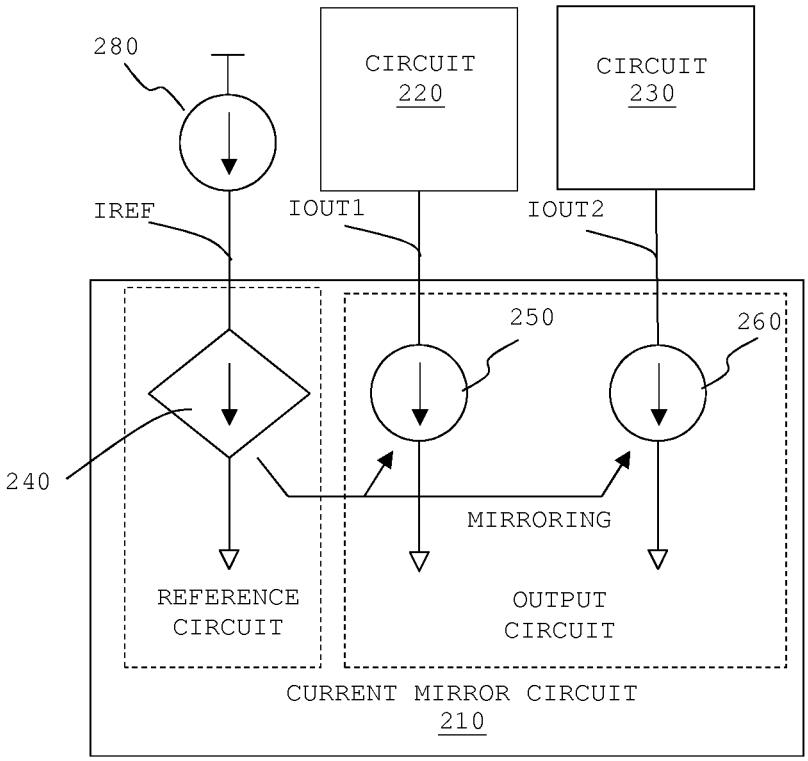
FIG. 2 shows an illustrative current mirror circuit coupled to two circuits in accordance with one embodiment of the present invention.

FIG. 2, meant to be illustrative and not limiting, shows an illustrative current mirror circuit 210 coupled to two other circuits 220 and 230 in accordance with one embodiment of the present invention. In one embodiment, circuit 220 may be a sub-circuit within a PLL circuit 130 of FIG. 1 and circuit 230 may be a sub-circuit within a transceiver block 120 of FIG. 1.

It should be appreciated that the part of current mirror circuit 210 that receives a reference current may be commonly referred to as a reference circuit. In the embodiment of FIG. 2, the reference circuit includes read-section circuit 240, which receives reference electrical current (IREF) from current source 280. Accordingly, the portion of current mirror circuit 210 that generates an output current by mirroring the reference current may be commonly referred to as an output circuit. In the embodiment of FIG. 2, the output circuit includes current sinks 250 and 260 that transmit their respective output currents (IOUT1 and IOUT2) to the respective ground terminals.

Still referring to FIG. 2, circuits 220 and 230 may be coupled to current sinks 250 and 260 respectively. The output current IOUT1 is transmitted out from circuit 220 through current sink 250 to a ground terminal. Similarly, the output current IOUT2 is transmitted out from circuit 230 through current sink 260 to another ground terminal.

Currents IOUT1 and IOUT2 may be substantially proportional to the IREF current. For example, an increase in IREF may be directly reflected by an increase IOUT1 and IOUT2. In one embodiment, the IOUT1 and IOUT2 currents may be identical to the IREF current (i.e., IOUT1=IOUT2=IREF). In such instances, current mirror circuit 210 may have a current mirroring factor of 1. However, the ratio of IOUT1 and IOUT2 to IREF depends on physical dimensions of circuit structures that form current source 240 and current sinks 250 and 260. For example, when current sink 250 is implemented using a transistor having a width that is double that of a transistor that is used to implement current source 240, IOUT1 may be twice the amount of IREF (i.e., IOUT=2IREF). In such instance, the current mirroring factor is equal to 2. It should be appreciated that one of the intrinsic characteristics of current mirror circuit 210 is that IOUT1 and IOUT2 may remain relatively stable for different types of circuits 220 and 230.

Figure 3:
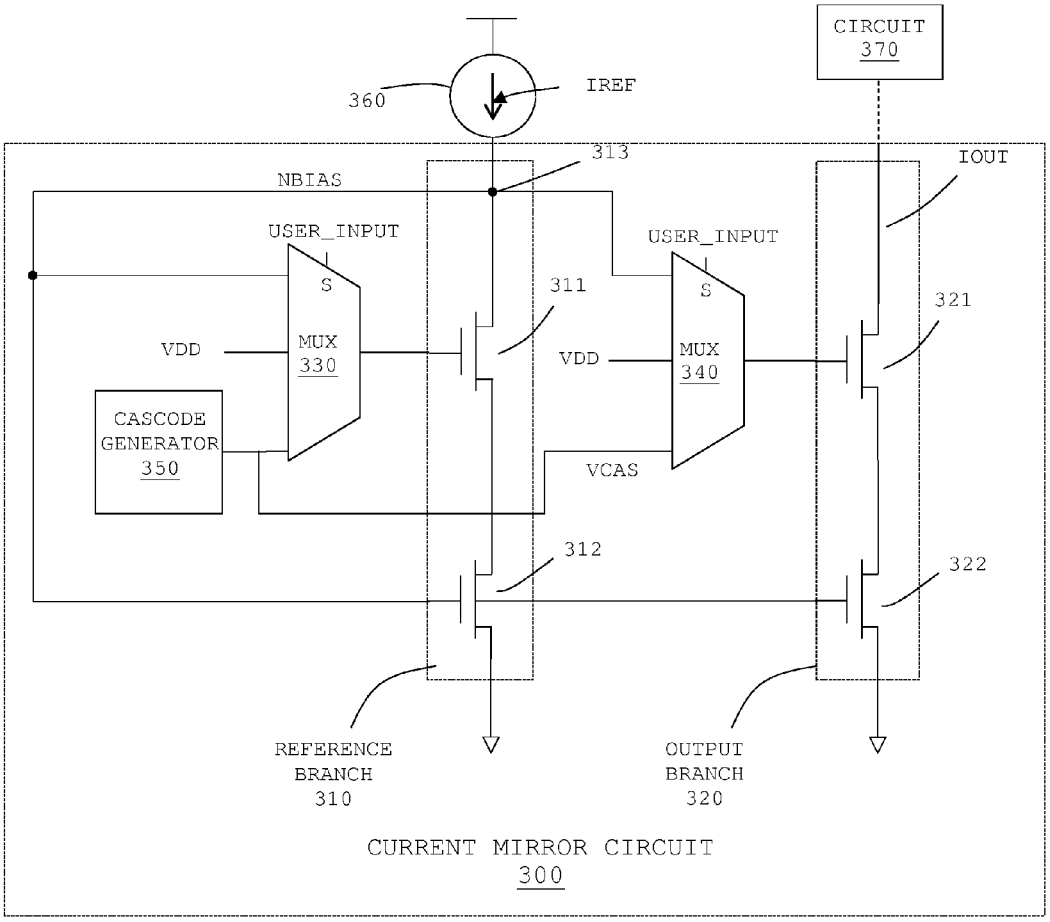
FIG. 3 shows an implementation of a current mirror circuit in accordance with one embodiment of the present invention.

FIG. 3, meant to be illustrative and not limiting, depicts an implementation of a current mirror circuit in accordance with one embodiment of the present invention. Current mirror circuit 300 may be a detailed implementation of current mirror circuit 210 shown in FIG. 2. Current mirror circuit 300 may be used to drive out an output current from circuit 370. In one embodiment, circuit 370 may be similar to a sub-circuit in PLL 130 of FIG. 1 or a sub-circuit in transceiver block 120 of FIG. 1.

Current mirror circuit 300 may be configurable to operate in different modes. In one embodiment, current mirror circuit 300 may be operated in one of these modes: (i) a cascode mode, (ii) a baseline mode, and (iii) a reduced-offset mode. It should be appreciated that there may be advantages and disadvantages with respect to different modes. For example, current mirror circuit 300 configured to the cascode mode may have a high output impedance that prevents high electrical current fluctuations when the loading (i.e., resistance) to current mirror circuit 300 is changed. This may be particularly useful in an FPGA device where the current mirror circuit 300 may be coupled to a configured circuit, which may be configured differently depending on the user requirements. Therefore, a user knowing this information may select a desired mode to obtain an output current. Current mirror circuit 300 may include other modes (e.g., Wilson mode, a resistor-biased mode or a regulated-cascode mode) to provide different options to obtain a desired output current.

In the embodiment of FIG. 3, current mirror circuit 300 includes reference branch 310, output branch 320, and multiplexers 330 and 340. Current mirror circuit 300 may also include cascode generator 350 and current source 360. Reference branch 310 may include serially-coupled n-channel metal oxide semiconductor (NMOS) transistors 311 and 312. Accordingly, output branch 320 may include serially-coupled NMOS transistors 321 and 322.

Still referring to FIG. 3, reference branch 310 may be coupled to current source 360 at node 313. Node 313 is also coupled to a first source-drain terminal of NMOS transistor 311. NMOS transistor 311 includes a gate terminal that may be coupled to an output terminal of multiplexer 330 and a second source-drain terminal that may be coupled a first source-drain terminal of NMOS transistor 312. NMOS transistor 312 includes a gate terminal that may be coupled to node 313 and a second source-drain terminal that may be coupled to a ground voltage.

Referring to output branch 320, NMOS transistor 321 has a gate terminal coupled to an output terminal of multiplexer 340 and a first source-drain terminal coupled to a first source-drain terminal of NMOS transistor 322. The gate terminal of NMOS transistor 322 may be coupled to node 313 and a second source-drain terminal may be coupled to a ground voltage. A second source-drain terminal of NMOS transistor 321 is coupled to circuit 370.

In one embodiment, the channel length and width for each of the NMOS transistors 311, 312, 321 and 322 may be similar. For example, each NMOS transistor 311, 312, 321 and 322 may have a width of 10 microns (μm) and a channel length of 0.18 μm. It should be appreciated NMOS transistors 311, 312, 321, and 322 with equal channel length and width may generate an output current that is identical to a reference current (i.e., IOUT=IREF).

However, it should be appreciated that most of the time, there may be differences in the dimensions of NMOS transistors 311, 312, 321 and 322, which may generate an output current that is different from the reference current (i.e., IOUT≠IREF). The differences may be caused by acceptable variations at the manufacturing process (i.e., variations within the tolerance accepted in that particular manufacturing process). Such differences usually may follow a statistical model (e.g., normal distribution model) that has a specific statistical deviation, in one embodiment. Accordingly, the difference between the output current and the reference current may follow a similar statistical model with a similar statistical deviation. Generally, the statistical deviation of the physical dimensions may be inversely proportional to the dimensions/area of NMOS transistors 311, 312, 321 and 322 (i.e., the larger the size of the NMOS transistors 311, 312, 321 and 322, the smaller difference between their dimensions).

In the embodiment of FIG. 3, multiplexers 330 and 340 have three input terminals respectively. Each input terminal for multiplexers 330 and 340 receives control signals that are at specific voltage levels. In one exemplary embodiment, the three control signals may include a bias voltage (NBIAS), a supply voltage (VDD), and a cascode voltage (VCAS). Multiplexers 330 and 340 receive user inputs at their respective select terminals (S). Depending on the user inputs, multiplexers 330 and 340 may selectively transmit a control signal to the gate terminals of NMOS transistors 311 and 312, respectively.

The selected control signal may determine the operating mode for current mirror circuit 300. In one embodiment, when the VCAS signal is selected at multiplexers 330 and 340, current mirror circuit 300 may be placed in a cascode mode.

When placed in the cascode mode, current mirror circuit 300 may have large output impedances at output branch 320, and may exhibit a low current swing at its output branch 320. In one exemplary embodiment, output impedance at output branch 320 may be 300 Kilo Ohm (kOhm). Therefore, even when the received voltage from load circuit swings, the current transmitting through output branch 320 may remain at a stable value. A user may select the cascode mode to obtain a high output impedance when the output current and reference current are identical.

Alternatively, when the NBIAS signal is selected, current mirror circuit 300 may be placed in a reduced-offset mode. It should be appreciated that the reduced-offset mode may be selected when there is a large mismatch between the values of the output current and the reference current, which may happen when there is a large difference in the dimensions of the respective NMOS transistors 311, 312, 321 and 322. In one embodiment, the reduced-offset mode may be selected when the mismatch is greater than a predetermined threshold (e.g., a value defined by a user of current mirror circuit 300). Generally, the reduced-offset mode is selected when the value of the output current is at least 2 times the value of the reference current.

Therefore, in the reduced-offset mode, the reference current and the output current may be required to transmit through a longer electrical length (i.e., a larger resistive pathway) compared to the cascode mode. NMOS transistors 311 and 321 may be responsible for mirroring the reference current to the output current. NMOS transistors 312 and 322, however, are operating in a linear region within the current-voltage (I-V) relationship (i.e., the resistive region) and that may help reduce the amount of current propagating through NMOS transistors 311 and 321.

When the VDD signal is selected, current mirror circuit 300 may be placed in a baseline mode. The baseline mode may be selected when the reduced-offset mode shows excessive voltage swing (e.g., a voltage swing of 0.2 V). In the baseline mode, the VDD voltage supplied to NMOS transistor 311 and 321 places NMOS transistors 312 and 322 to function in the saturation region within the current-voltage relationship. Hence, NMOS transistors 311 and 321 operate as switches for respective NMOS transistors 312 and 322.

The VCAS voltage level may be generated by cascode generator 350. An output from cascode generator 350 may be coupled to multiplexers 330 and 340. In one embodiment, changing the VCAS voltage level with cascode generator 350 may alter the output impedance at output branch 320. Therefore, cascode generator 350 may be utilized to tune VCAS voltage level to provide a constant output current at an output impedance that a user requires.

Referring still to FIG. 3, the voltage level for VDD voltage signal may be greater than the VCAS voltage signal, and the voltage level for VCAS voltage signal may be greater than the NBIAS voltage signal. It should be appreciated that the voltage levels for the VCAS, NBIAS and VDD voltage signals may depend on two factors: (i) the threshold voltage (Vt), and (ii) the overdrive voltage (Vov), of the respective NMOS transistors 311 and 321. Formulas (1), (2), and (3) below show VCAS, NBIAS and VDD in terms of Vt and Vov:

$$VCAS=Vt+2Vov \tag{1}$$

$$NBIAS=Vt+\text{sqrt}(2)\times Vov \tag{2}$$

$$VDD=2\times(Vt+Vov) \tag{3}$$

In one embodiment, the voltage level for the VDD voltage may be 1.6 volt (V), the VCAS voltage may be 1 V and the NBIAS voltage level may be 0.8 V.

Figure 4:
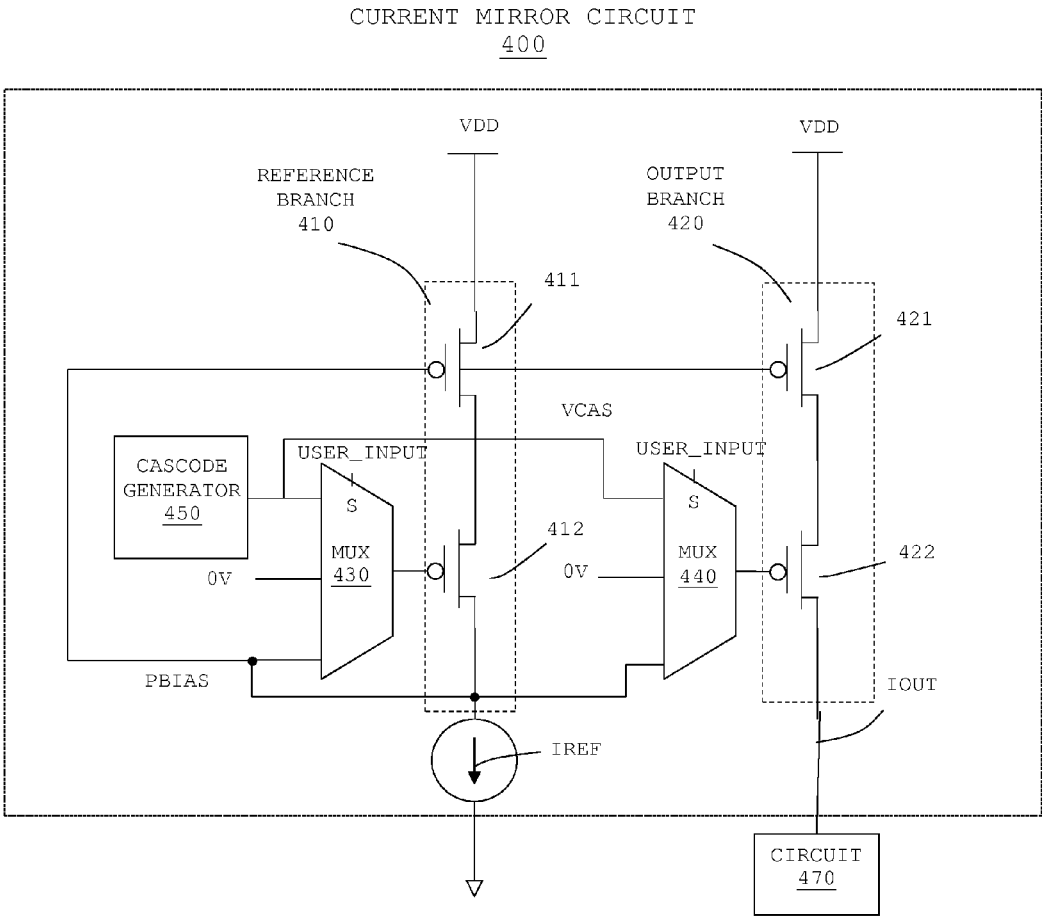
FIG. 4 shows an implementation of a current mirror circuit with p-channel metal oxide semiconductor (PMOS) transistors in accordance with one embodiment of the present invention.

FIG. 4, meant to be illustrative and not limiting, illustrates an implementation of a current mirror circuit with p-channel metal oxide semiconductor (PMOS) transistors in accordance with one embodiment of the present invention. Current mirror circuit 400 may share similarities with current mirror circuit 300 of FIG. 3 and as such, elements that have been described above with reference to FIG. 3 are not described in detail (e.g., reference circuit 410, output circuit 420, etc.). Current mirror circuit 400 may also provide similar configuration modes as those provided by current mirror circuit 300 of FIG. 3 (e.g., baseline mode, cascode mode or reduced-offset mode). Multiplexers 430 and 440 may selectively transmit different signals or voltage levels depending on the configuration of current mirror circuit 400 (as described above with reference to FIG. 3). In FIG. 4, however, multiplexers 420 and 440 received 0 V on one of its input terminal instead of VDD voltage signal for multiplexers 330 and 340 of FIG. 3. Selecting 0 V to transmit through multiplexers 420 and 440 may place current mirror circuit 400 in the baseline mode.

In the embodiment of FIG. 4, PMOS transistors 411, 412, 421 and 422 are used in current mirror circuit 400. Current mirror circuit 400 may be coupled to circuit 470 at a source-drain terminal on PMOS transistor 422. Current mirror circuit 400 may be a current source to circuit 470. Circuit 470 may be similar to circuit 220 or 230 of FIG. 2.

The formulas (4) and (5) below show VCAS and PBIAS in terms of Vt and Vov:

$$VCAS=VDD-(2Vov+Vt) \tag{4}$$

$$PBIAS=VDD-(Vt+\text{sqrt}(2)\times Vov) \tag{5}$$

In one embodiment, the voltage level for VDD voltage level may be 1.6 V, VCAS voltage level may be 0.6 V and PBIAS voltage level may be 0.8 V. The different relationship between formulas (4) and (1) may provide for the differences between the VCAS voltage level in current mirror circuit 400 and the VCAS voltage level for current mirror circuit 300 of FIG. 3.

It should be appreciated current mirror circuit 300 of FIG. 3 (having NMOS transistors 311, 312, 321 and 322) may be able to mirror a reference electrical current faster than current mirror circuit 400 of FIG. 4 (having PMOS transistors 411, 412, 421 and 422). This is because NMOS transistors are generally faster at transferring signals than PMOS transistors.

Figure 5:
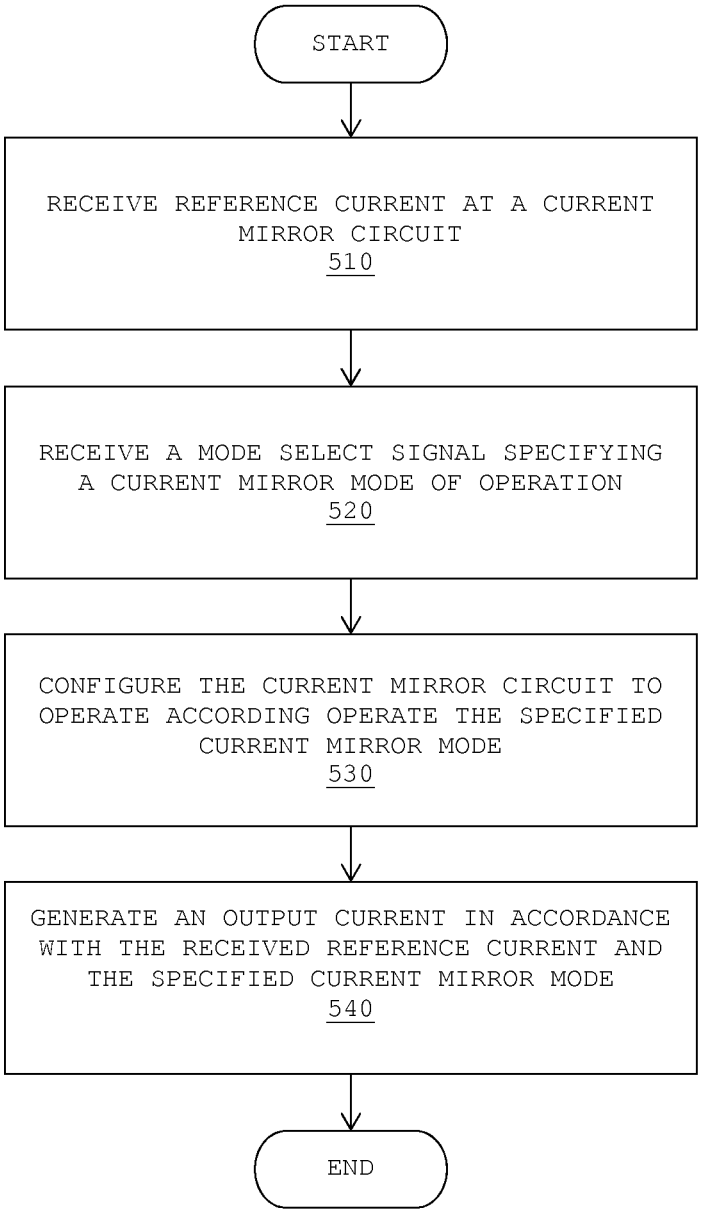
FIG. 5 shows an illustrative flowchart of a method of operating a current mirror circuit in accordance with one embodiment of the present invention.

FIG. 5, meant to be illustrative and not limiting, shows illustrative steps for operating a current mirror circuit in accordance with one embodiment of the present invention. The steps shown in FIG. 5 may be performed by current mirror circuit 300 of FIG. 3 or current mirror circuit 400 of FIG. 4. At step 510, a reference current may be received at a reference circuit of the current mirror circuit. The reference circuit may be similar to reference branch 310 of FIG. 3 or reference circuit 410 of FIG. 4. The reference current may be similar to the reference current IREF of FIG. 3.

At step 520, a mode control signal specifying a current mirror mode of operation is received by a mode selector circuit. In one embodiment, the mode selector circuit may be similar to multiplexers 330 and 340 of FIG. 3 or multiplexers 430 and 440 of FIG. 4. The mode selector circuit may selectively transmit one of the three signals received at its respective input terminals as the mode control signal. The signals may be: (i) VCAS voltage signal, (ii) NBIAS voltage signal and (iii) VDD voltage signal of FIGS. 3 and 4. Each signal may place the current mirror circuit in a specific mode. For example, the VCAS voltage signal may place the current mirror circuit in a cascode mode. Alternatively, the NBIAS voltage signal may place the current mirror circuit in a reduced-offset mode while the VDD voltage signal may place the current mirror circuit in a baseline mode.

At step 530, the current mirror circuit is configured to operate according to the specified current mirror mode. In one embodiment, when the VCAS voltage signal is selected, the output circuit of the current mirror circuit may have high output impedance. When the NBIAS voltage signal is selected, the current propagating through the output current branch may need to propagate through a longer current pathway. When the VDD voltage signal is selected, the current mirror circuit may generate output impedance that is lower than when the current mirror circuit is in the cascode mode but higher than when current mirror circuit is in the reduced-offset mode.

At step 540, an output current is generated by the current mirror in accordance with received reference current and the specified current mirror mode. The output current may be substantially proportional to the reference current received at the reference circuit. In one embodiment, the output current may be similar to IOUT of FIGS. 3 and 4, or IOUT1 and IOUT2 received, respectively, from circuits 220 and 230 of FIG. 2.

Figure 6:
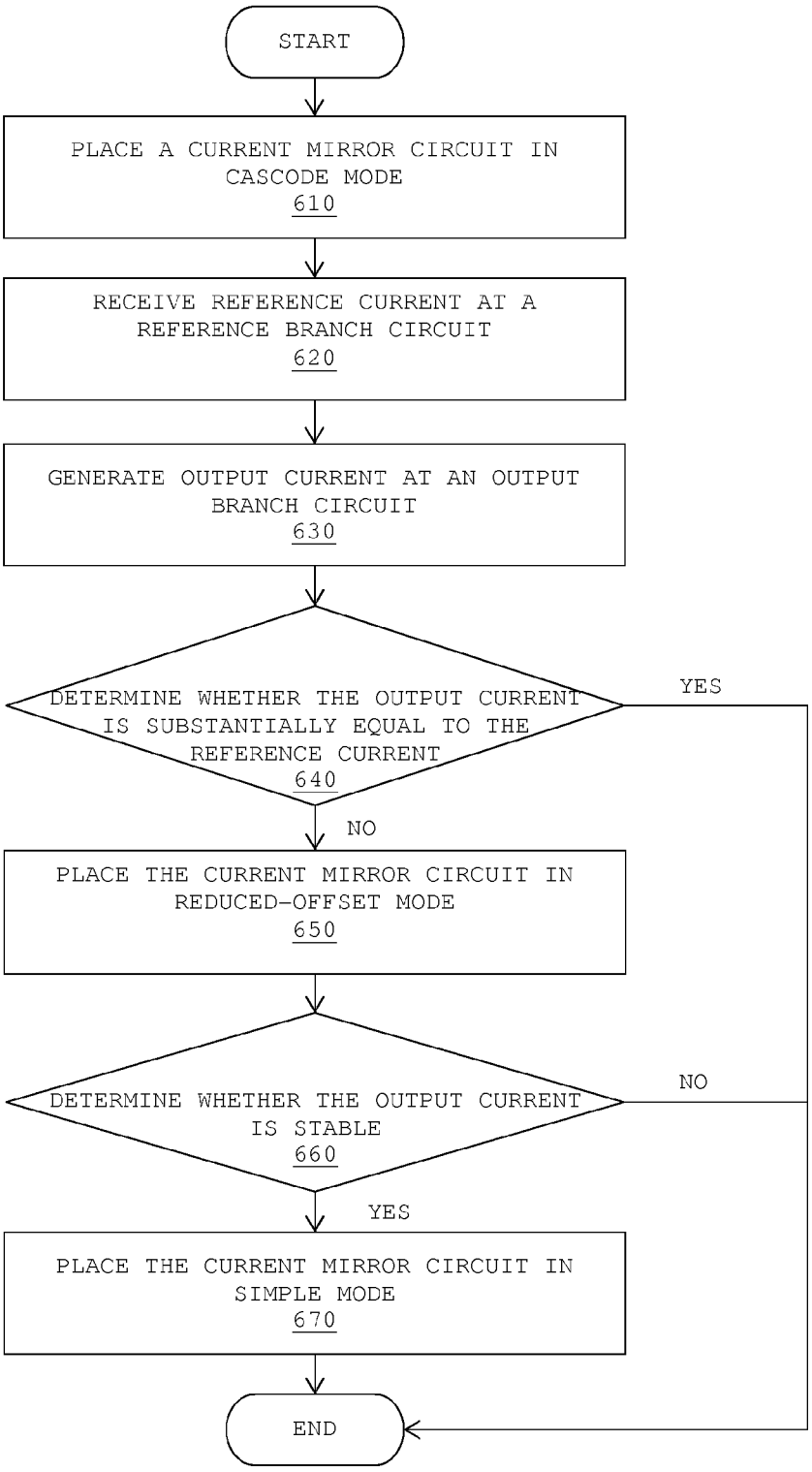
FIG. 6 shows an illustrative flowchart of a method of configuring a current mirror circuit in accordance with one embodiment of the present invention.

FIG. 6, meant to be illustrative and not limiting, shows steps for configuring a current mirror circuit in accordance with one embodiment of the present invention. At step 610, the current mirror circuit is placed in a cascode mode. The current mirror circuit may be placed in the cascode mode by selectively transmitting a cascode voltage signal (UCAS) via a mode selector circuit (e.g., multiplexers 330 and 340 of FIG. 3). It should be appreciated that a current mirror circuit configured to be in a cascode mode may have high output impedances at its output circuit. Therefore, the current mirror circuit may have a stable output current (i.e., low output current swing). At step 620, a reference current may be received at a reference circuit of the current mirror circuit. In one embodiment, the reference current may be similar to the reference current IREF of FIG. 3 or FIG. 4. At step 630, an output current may be generated at an output circuit. The current mirror circuit in the cascode mode may generate a relatively small output current compared to the current circuit in the baseline mode or the reduced-offset mode.

At step 640, the output current and the reference current are compared to determine whether they are equal to each other. It should be appreciated that the output current may be similar to the reference current when the reference circuit and the output circuit have similar transistor dimensions (i.e., when the transistors are designed to be identical and have no significant manufacturing defects). Hence, if the comparison shows that the output current and the reference current are substantially equal, the method ends. However, if the output current is different than the reference current, then the method may proceed to step 650.

At step 650, the current mirror circuit may be placed in a reduced-offset mode. The current mirror circuit may be placed in the reduced-offset mode by selectively transmitting an NBIAS voltage signal via a mode selector circuit. The current mirror circuit configured to be in the reduced-offset mode may provide an output current that is similar to the reference current.

At step 660, the output current may be measured to determine whether the output current is stable. It should be appreciated that when the output impedance is reduced after a switch from the cascode mode to the reduced-offset mode, the output current may become less stable (i.e., the output current swings). If the output current is stable, the configuration of the current mirror circuit may end at step 660.

If the output current is not stable, the current mirror circuit may be placed in a baseline mode. The current mirror circuit may be placed in the baseline mode by selectively transmitting a VDD voltage signal via a mode selector circuit. As described above, a current mirror circuit placed in the baseline mode may provide an output impedance that is lower than when the current mirror circuit is in cascode mode but higher than when current mirror circuit is in reduced-offset mode.

The embodiments thus far have been described with respect to integrated circuits. The methods and apparatuses described herein may be incorporated into any suitable circuit. For example, they may be incorporated into numerous types of devices such as programmable logic devices, application specific standard products (ASSPs), and application specific integrated circuits (ASICs). Examples of programmable logic devices include programmable arrays logic (PALs), programmable logic arrays (PLAs), field programmable logic arrays (FPGAs), electrically programmable logic devices (EPLDs), electrically erasable programmable logic devices (EEPLDs), logic cell arrays (LCAs), complex programmable logic devices (CPLDs), and field programmable gate arrays (FPGAs), just to name a few.

The programmable logic device described in one or more embodiments herein may be part of a data processing system that includes one or more of the following components: a processor; memory; IO circuitry; and peripheral devices. The data processing can be used in a wide variety of applications, such as computer networking, data networking, instrumentation, video processing, digital signal processing, or any suitable other application where the advantage of using programmable or re-programmable logic is desirable. The programmable logic device can be used to perform a variety of different logic functions. For example, the programmable logic device can be configured as a processor or controller that works in cooperation with a system processor. The programmable logic device may also be used as an arbiter for arbitrating access to a shared resource in the data processing system. In yet another example, the programmable logic device can be configured as an interface between a processor and one of the other components in the system. In one embodiment, the programmable logic device may be one of the family of devices owned by ALTERA Corporation.

Although the methods of operations were described in a specific order, it should be understood that other operations may be performed in between described operations, described operations may be adjusted so that they occur at slightly different times or described operations may be distributed in a system which allows occurrence of the processing operations at various intervals associated with the processing, as long as the processing of the overlay operations are performed in a desired way.

Although the foregoing invention has been described in some detail for the purposes of clarity, it will be apparent that certain changes and modifications can be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A current mirror circuit, comprising:

a reference circuit having an input terminal that receives a reference current;

an output circuit that is coupled to the reference circuit and that generates an output current that is proportional to the reference current; and a mode selector circuit coupled to the reference circuit and the output circuit, wherein the mode selector circuit comprises a multiplexer that receives a mode select signal specifying a selected current mirror mode of operation and that has a data input that receives a power supply voltage that is fixed throughout operation of the current mirror circuit.

2. The current mirror circuit as defined in claim 1, wherein the mode selector circuit generates a first mode control signal that places the current mirror circuit in a cascode mode, a second mode control signal that places the current mirror circuit in a baseline mode, and a third mode control signal that places the current mirror circuit in a reduced-offset mode.

3. The current mirror circuit as defined in claim 2, wherein the reference circuit further comprising:

first and second transistors coupled in series, wherein a gate terminal of the first transistor is coupled to the mode selector circuit, and wherein a gate terminal of the second transistor receives the third mode control signal.

4. The current mirror circuit as defined in claim 3, wherein the output circuit further comprising:

third and fourth transistors coupled in series, wherein a gate terminal of the third transistor is coupled to the mode selector circuit and wherein a gate terminal of the fourth transistor receives the third mode control signal.

5. The current mirror circuit as defined in claim 4, wherein:

the output circuit exhibits a first output impedance when the current mirror is placed in the cascode mode; and the output circuit exhibits a second output impedance that is lower than the first output impedance when the current mirror is placed in the baseline line and the reduced-offset mode.

6. The current mirror circuit as defined in claim 4, wherein the output current is equal to the reference current when the current mirror circuit is in the reduced-offset mode.

7. The current mirror circuit as defined in claim 4, wherein the second and fourth transistors are in current saturation mode when the current mirror circuit is in the baseline mode.

8. The current mirror circuit as defined in claim 2, wherein the first mode control signal has a voltage level that is greater than that of the second mode control signal, and wherein the second mode control signal has a voltage level that is greater than that of the third mode control signal.

9. A method of operating a current mirror circuit having a reference circuit branch and an output circuit branch, comprising:

receiving a selected one of a plurality of mode control signals through a mode selector circuit, wherein each mode control signal in the plurality of mode control signals is used to place the current mirror circuit in a different mode;

receiving a reference current on the reference circuit branch;

generating an output current on the output circuit branch that is proportional to the reference current based on the mode in which the current mirror circuit is operating; and selecting the mode control signal from first, second and third mode control signals, wherein the first mode control signal places the current mirror circuit in to a cascode mode, the second mode control signal places the current mirror circuit in to a baseline mode and the third mode control signal places the current mirror circuit in to a reduced-offset mode.

10. The method as defined in claim 9, wherein the reference circuit branch comprises first and second transistors coupled in series, further comprising:

controlling the first transistor with the mode control signal; and applying a bias voltage to the second transistor.

11. The method as defined in claim 10, wherein the output circuit branch comprises third and fourth transistors coupled in series, further comprising:

controlling the third transistor with the mode control signal; and applying the bias voltage to the fourth transistor.

12. The method as defined in claim 9, further comprising:

while the current mirror circuit is placed in the baseline mode, exhibiting a first output impedance;

while the current mirror circuit is placed in the reduced-offset mode, exhibiting a second output impedance that is different than the first output impedance; and while the current mirror circuit is placed in the cascode mode, exhibiting a third output impedance that is greater than the first output impedance and greater than the second output impedance.

13. The method as defined in claim 9, further comprising:

when the current mirror circuit is in the reduced-offset mode, generating the output current that is identical to the reference current.

14. The method as defined in claim 9, further comprising:

when the current mirror circuit is in the baseline mode, generating the output current that is proportional to the reference current and that swings less when the mode control signal is the baseline mode signal.

15. A method of operating a current mirror circuit, wherein the current mirror circuit includes a reference branch, an output branch, and a mode selector circuit for selecting an operating mode for the current mirror circuit, the method comprising:

with the mode selector circuit, placing the reference branch and the output branch of the current mirror circuit in a cascode current mode; and comparing a reference current that is received by the reference branch of the current mirror circuit and an output current that is generated by the current mirror circuit.

16. The method as defined in claim 15, further comprising:

in response to determining that a mismatch between the reference current and the output current is greater than a predetermined threshold, placing the current mirror circuit in a reduced-offset mode.

17. The method as defined in claim 16, further comprising:

observing voltage swings that occur at an output terminal of the current mirror circuit when the current mirror circuit is placed in the reduced-offset mode.

18. The method as defined in claim 17, further comprising:

when the voltage swings are greater than another predetermined threshold, selecting a baseline mode for the current mirror circuit, wherein the current mirror circuit exhibits a first output impedance when operated in the cascade mode, and wherein the current mirror circuit exhibits a second output impedance when operated in the baseline mode that is lower than the first output impedance.

* * * * *